US010954724B2

(12) United States Patent
Park et al.

(10) Patent No.: US 10,954,724 B2
(45) Date of Patent: Mar. 23, 2021

(54) AXIAL AND ROTATIONAL ALIGNMENT SYSTEM AND METHOD

(71) Applicants: Do Seo Park, Houston, TX (US); Michael Manera, Tomball, TX (US); Carlos Rivero, Katy, TX (US); Marc Samuelson, Houston, TX (US)

(72) Inventors: Do Seo Park, Houston, TX (US); Michael Manera, Tomball, TX (US); Carlos Rivero, Katy, TX (US); Marc Samuelson, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 346 days.

(21) Appl. No.: 16/018,830

(22) Filed: Jun. 26, 2018

(65) Prior Publication Data

US 2019/0390522 A1 Dec. 26, 2019

(51) Int. Cl.
*E21B 17/046* (2006.01)
*E21B 47/13* (2012.01)

(52) U.S. Cl.
CPC ..... *E21B 17/046* (2013.01); *E21B 47/13* (2020.05)

(58) Field of Classification Search
CPC .. E21B 17/046; E21B 17/0465; E21B 23/006; E21B 23/02
See application file for complete search history.

(56) References Cited

U.S. PATENT DOCUMENTS 3,361,453 A * 1/1968 Brown ..... F16L 15/08 285/321
3,405,763 A * 10/1968 Pitts ..... E21B 33/043 166/382
4,239,083 A 12/1980 Silberman et al.
5,579,829 A * 12/1996 Comeau ..... E21B 23/02 166/117.6
5,655,602 A * 8/1997 Collins ..... E21B 7/068 166/313
6,202,746 B1 3/2001 Vandenberg et al.
8,286,708 B2 * 10/2012 Assal ..... E21B 23/06 166/313
2001/0027866 A1 * 10/2001 George ..... E21B 23/12 166/313
2002/0023782 A1 * 2/2002 Appleton ..... E21B 17/1085 175/325.3
2002/0162656 A1 * 11/2002 Dewey ..... E21B 23/01 166/117.5
2008/0196891 A1 8/2008 Mailand et al.
2016/0145971 A1 5/2016 Manera et al.
2016/0237759 A1 8/2016 Li-Leger et al.
2016/0237805 A1 * 8/2016 Gosney ..... E21B 47/024
(Continued)

OTHER PUBLICATIONS

Notification of Transmittal of the International Search Report and Written Opinion of the International Searching Authority, or the Declaration; PCT/US2019/038376; dated Oct. 8, 2019; 8 pages.

*Primary Examiner* — Shane Bomar
(74) *Attorney, Agent, or Firm* — Cantor Colburn LLP

(57) ABSTRACT

An axial and rotational alignment system including a casing string having an axial orientation feature and a rotational orientation feature; and a tubing string having an axial and rotational orientation assembly thereon, the assembly including a rotational alignment subassembly having a selectively actuable member that is selectively engagable with the rotational orientation feature.

18 Claims, 3 Drawing Sheets

(56) References Cited

U.S. PATENT DOCUMENTS

| | | | | |
|---|---|---|---|---|
| 2017/0211346 | A1* | 7/2017 | Bullock | E21B 23/006 |
| 2018/0106140 | A1* | 4/2018 | Barrilleaux | E21B 47/001 |
| 2018/0156000 | A1* | 6/2018 | Cleven | E21B 23/02 |
| 2018/0187519 | A1* | 7/2018 | Rodriguez | E21B 23/12 |

* cited by examiner

AXIAL AND ROTATIONAL ALIGNMENT SYSTEM AND METHOD

BACKGROUND

In the resource recovery industry it is often the case that communication between something on a tubing string, for example, and a casing string, for example. This might be ports for fluid, signals such as electromagnetic (EM) or acoustic signals, etc. Often, operators will use known locations downhole and space out subs to get relevant structures axially aligned. While these help, greater granularity with alignment would be welcomed in the art.

SUMMARY

An axial and rotational alignment system including a casing string having an axial orientation feature and a rotational orientation feature; and a tubing string having an axial and rotational orientation assembly thereon, the assembly including a rotational alignment subassembly having a selectively actuable member that is selectively engagable with the rotational orientation feature.

A method for axially and rotationally orienting a communications system including engaging a dog of the system of any prior embodiment into the recess in the casing; moving the tubing string to rotate the rotational alignment subassembly; actuating the selectively actuable member; and engaging the selectively actuable member with the recess of the casing.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
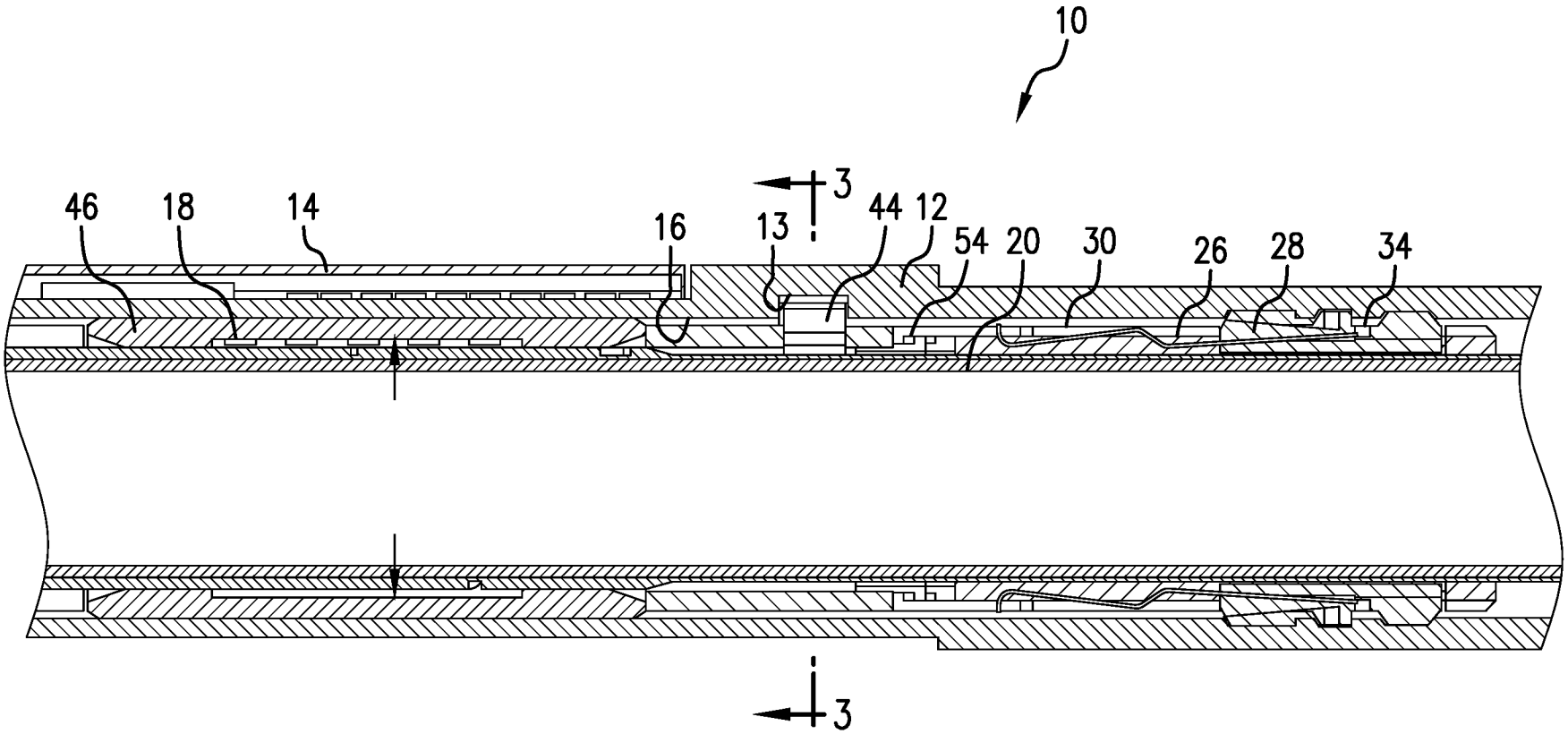
FIG. 1 is a cross sectional view of a system as disclosed herein.

Referring to FIG. 1, an axial and rotational alignment system 10 is illustrated in cross section. It will be appreciated that the system includes a casing 12 having a communication configuration 14 at a position radially outward of an inside surface 16 of the casing 12 and a recess 13 in the casing 12. This casing is to be run into a borehole (not shown) and may represent an outermost casing or may represent any one of several more inwardly disposed casings. The number of casings is not germane to the invention. Rather, it is the position of the communication configuration 14 in a position relative to the casing 12 that is not accessible from the inside surface 16 of the casing 12 that is relevant. Stated alternatively, communications to and from the communication configuration 14 must pass through the casing 12. It has been discovered that for this reason, it is important to align a communication device 18 with the communication configuration 14 both rotationally and axially. It is this system disclosed herein accomplishes with aplomb.

Figure 2:
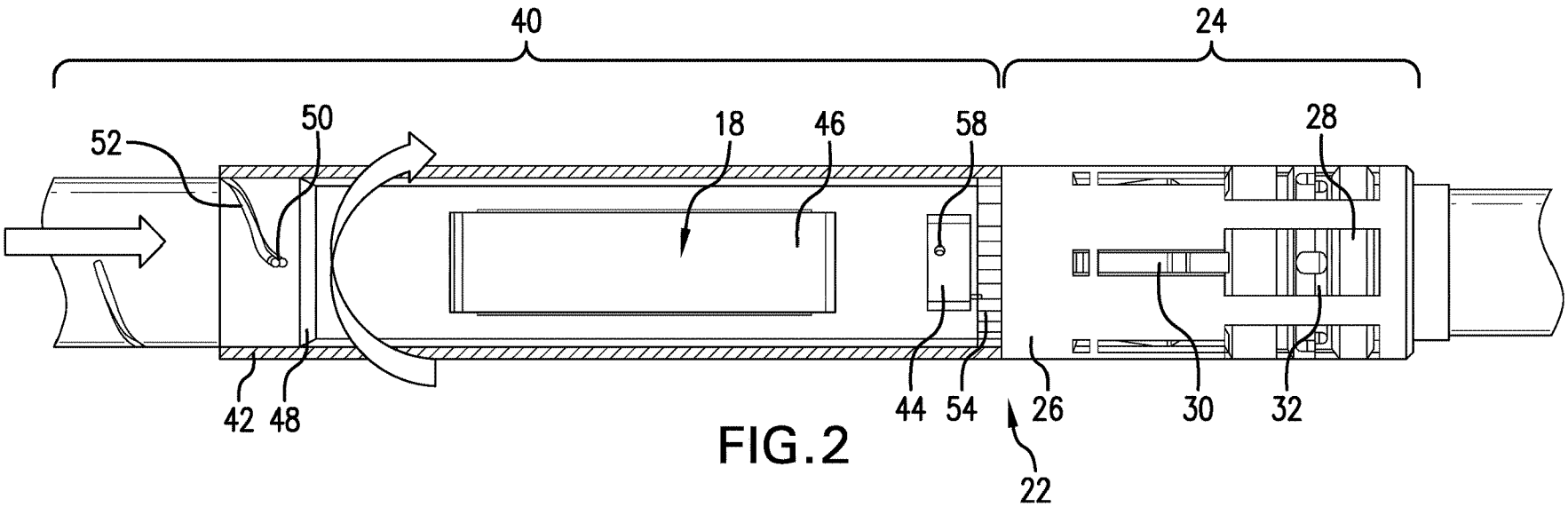
FIG. 2 is a partial transparent side view of an axial and rotational orientation assembly.

Referring to FIGS. 1 and 2 simultaneously, in general, the casing 12 is run in the borehole first and affixed or anchored appropriately. Then a tubing string 20 having an axial and rotational orientation assembly 22 (see FIG. 2) thereon is run in the hole. The assembly 22 includes an axial alignment subassembly 24 comprising a dog housing 26, a dog 28 (three visible) and a biasing member 30 (three being at least partially visible). The dog 26 includes a profile 32 that will match a complementary engagement feature 34 in the casing 12. Upon the axial and rotational orientation assembly 22 reaching the casing engagement feature 34, the dog 26 will automatically engage therewith based upon the biasing member 30 urging the dog 26 radially outwardly into engagement therewith. This will locate the axial and rotational orientation assembly 22 axially and secure it in that location.

Figure 4:
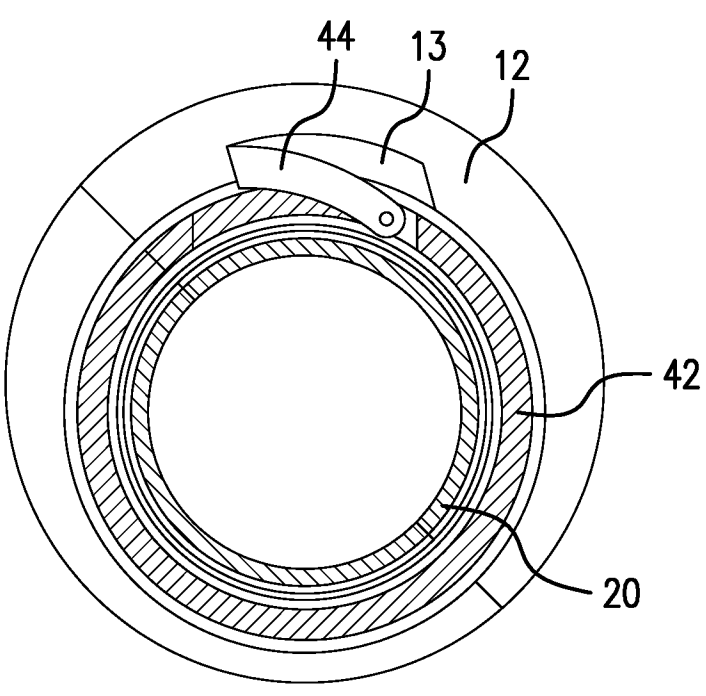
FIG. 4 is the view of FIG. 3 with the axial and rotational orientation assembly in a second position.
Figure 3:
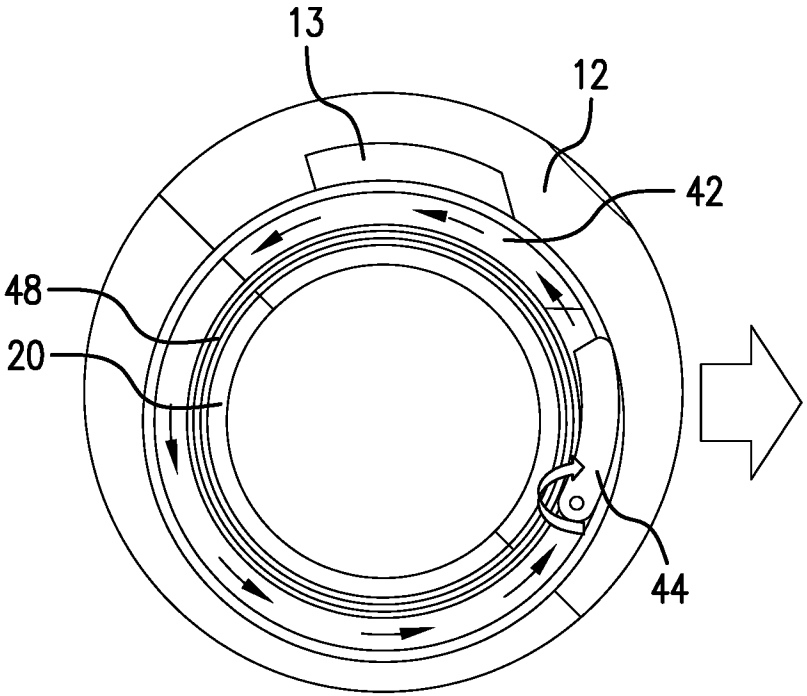
FIG. 3 is a cross sectional view of FIG. 1 taken along section line 3-3 with the axial and rotational orientation assembly in a first position.

The axial and rotational orientation assembly 22 also comprises a rotational alignment subassembly 40. The rotational alignment subassembly comprises a body 42 rotatably mounted to the tubing string 20. The body 42 supports a selectively actuable member 44 that in some embodiments may be a pawl. The member 44 is configured to move from a run in position (shown in FIG. 3) where it is more radially inwardly disposed and temporarily held there by a release retainer 58 to a deployed position (shown in FIG. 4) where it is radially outwardly biased in order to ensure that the member 44 may engage and locate in the casing recess 13 and thereby stop rotational motion of the rotational alignment subassembly 40. The body 42 further supports the communications device 18, which may be by itself or may be disposed in a comm housing 46. The communications device 18 and or the comm housing 46 are radially outwardly displaceable relative to the body 42 during use in order to bring the communications device 18 into close proximity (and in iterations into contact) with the casing inside surface 16. This is accomplished by a cone 48 manipulable from a position that is not radially adjacent the communication device 18 to a position where the cone is directly radially inward of the communications device 18, which will result in the communications device 18 and/or the comm housing 46 being driven radially outwardly into the casing inside surface 16.

It will also be appreciated that the body 42 supports a cam pin 50 that is engaged with a helical groove 52 in the cone 48. The cone 48 moves with the tubing string 20. Axial motion of the tubing string 20 subsequent to the dog 26 engaging the casing engagement feature 34, will load the pin 50 in the helical groove 52 resulting in rotation of the body 42. This will continue until the selectively actuable member 44 is both deployed (by release of a release retainer 58, e.g. shear member, occasioned by the initial movement of the cone 48 relative to the selectively actuable member 44 and the release retainer 58, which causes shearing of the retainer 58) and engaged with the casing recess 13. Once the selectively actuable member 44 is engaged with the recess 13, the body 42 cannot rotate and load will build within the pin 50 until the pin 50 fails. At this point the cone 48 can continue to move axially to a position directly radially inward of the communication device 18 and/or the comm housing 46 thereby radially displacing those components into proximity and in some embodiments into contact with the casing inside surface 16.

Due to both the axial alignment subassembly 24 and the rotational alignment subassembly 40 having fixed their positions (axially and rotationally respectively), the communications device 18 and the communication configuration 14 are aligned both axially and rotationally thereby enhancing their communicative capability. It is to be appreciated that the communications device and the communication configuration may each be one of a receiver and a transmitter or they may both be transceivers. Further in an embodiment, both of the communications device and the communication configuration are transducers.

In an embodiment, it is also contemplated that a bearing or bushing 54 may be disposed between the axial alignment subassembly 24 and the rotational alignment subassembly 40 to reduce friction therebetween thus easing the rotational movement of the rotational alignment subassembly 40 relative to the axial alignment subassembly 24 during use.

Set forth below are some embodiments of the foregoing disclosure:

Embodiment 1: An axial and rotational alignment system including a casing string having an axial orientation feature and a rotational orientation feature; and a tubing string having an axial and rotational orientation assembly thereon, the assembly including a rotational alignment subassembly having a selectively actuable member that is selectively engagable with the rotational orientation feature.

Embodiment 2: The system as in any prior embodiment wherein the feature is a recess.

Embodiment 3: The system as in any prior embodiment wherein the member is radially extendible.

Embodiment 4: The system as in any prior embodiment wherein the member is biased to a radially extended position.

Embodiment 5: The system as in any prior embodiment wherein the member is a pawl.

Embodiment 6: The system as in any prior embodiment wherein the axial and rotational orientation assembly includes an axial alignment subassembly.

Embodiment 7: The system as in any prior embodiment wherein the axial alignment subassembly includes a dog housing and a dog biased radially outwardly from the dog housing.

Embodiment 8: The system as in any prior embodiment wherein the dog includes a profile at a surface thereof engagable with the casing string.

Embodiment 9: The system as in any prior embodiment wherein the rotational alignment subassembly includes a friction reducer at an interface between the rotational alignment subassembly and an axial alignment subassembly.

Embodiment 10: The system as in any prior embodiment wherein the rotational alignment subassembly includes a communication device.

Embodiment 10: The system as claimed in claim 10 wherein the communication device is a transceiver.

Embodiment 12: The system as in any prior embodiment wherein the communication device is a transducer.

Embodiment 13: The system as in any prior embodiment wherein the communication device is housed in a communication housing.

Embodiment 14: The system as in any prior embodiment wherein the communication housing is radially outwardly extendible toward the casing.

Embodiment 15: The system as in any prior embodiment wherein the rotational alignment subassembly includes a cam pin.

Embodiment 16: The system as in any prior embodiment wherein the cam pin is configured and dimensioned to be shearable at a selected load.

Embodiment 17: The system as in any prior embodiment wherein the tubing string includes a helical groove.

Embodiment 18: The system as in any prior embodiment wherein the rotational alignment subassembly houses the selectively actuable member.

Embodiment 19: A method for axially and rotationally orienting a communications system including engaging a dog of the system of any prior embodiment into the recess in the casing; moving the tubing string to rotate the rotational alignment subassembly; actuating the selectively actuable member; and engaging the selectively actuable member with the recess of the casing.

Embodiment 20: The method as in any prior embodiment wherein the moving is axial.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An axial and rotational alignment system comprising:

a casing string having an axial orientation feature and a rotational orientation feature; and a tubing string having an axial and rotational orientation assembly thereon, the assembly including a rotational alignment subassembly having a selectively actuable member that is selectively engagable with the rotational orientation feature, the rotational alignment subassembly including a communication device and wherein the communication device is radially outwardly extendible toward the casing.

2. The system as claimed in claim 1 wherein the rotational orientation feature is a recess.

3. The system as claimed in claim 1 wherein the member is radially extendible.

4. The system as claimed in claim 1 wherein the member is biased to a radially extended position.

5. The system as claimed in claim 1 wherein the member is a pawl.

6. The system as claimed in claim 1 wherein the axial and rotational orientation assembly includes an axial alignment subassembly.

7. The system as claimed in claim 6 wherein the axial alignment subassembly includes a dog housing and a dog biased radially outwardly from the dog housing.

8. The system as claimed in claim 7 wherein the dog includes a profile at a surface thereof engagable with the casing string.

9. The system as claimed in claim 1 wherein the rotational alignment subassembly includes a friction reducer at an interface between the rotational alignment subassembly and an axial alignment subassembly.

10. The system as claimed in claim 1 wherein the communication device is a transceiver.

11. The system as claimed in claim 1 wherein the communication device is a transducer.

12. The system as claimed in claim 1 wherein the communication device is housed in a communication housing.

13. An axial and rotational alignment system comprising:

a casing string having an axial orientation feature and a rotational orientation feature; and a tubing string having an axial and rotational orientation assembly thereon, the assembly including a rotational alignment subassembly having a selectively actuable member that is selectively engagable with the rotational orientation feature, the rotational alignment subassembly including a communication device and wherein the rotational alignment subassembly includes a cam pin.

14. The system as claimed in claim 13 wherein the cam pin is configured and dimensioned to be shearable at a selected load.

15. The system as claimed in claim 1 wherein the tubing string includes a helical groove.

16. The system as claimed in claim 1 wherein the rotational alignment subassembly houses the selectively actuable member.

17. A method for axially and rotationally orienting a communications system comprising:

engaging a dog of the system of claim 1 into the rotational orientation feature in the casing;

moving the tubing string to rotate the rotational alignment subassembly;

actuating the selectively actuable member; and engaging the selectively actuable member with the rotational orientation feature of the casing.

18. The method as claimed in claim 17 wherein the moving is axial.

* * * * *